US007370922B2

(12) United States Patent
Umeda

(10) Patent No.: US 7,370,922 B2
(45) Date of Patent: May 13, 2008

(54) INK JET RECORDING APPARATUS AND CONTROL METHOD THEREOF

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 183 days.

(21) Appl. No.: 11/420,638

(22) Filed: May 26, 2006

(65) Prior Publication Data

US 2006/0268025 A1 Nov. 30, 2006

(30) Foreign Application Priority Data

May 27, 2005 (JP) ..... 2005-156042

(51) Int. Cl.
*B41J 29/38* (2006.01)

(52) U.S. Cl. ..... 347/6; 347/5; 347/9

(58) Field of Classification Search ..... 347/5, 347/6, 9–12, 16–17, 19, 40
See application file for complete search history.

(56) References Cited

U.S. PATENT DOCUMENTS

| | | | | |
|---|---|---|---|---|
| 4,730,197 | A * | 3/1988 | Raman et al. | 347/40 |
| 5,495,270 | A * | 2/1996 | Burr et al. | 347/10 |
| 5,748,214 | A * | 5/1998 | Usui et al. | 347/70 |
| 6,592,214 | B2 | 7/2003 | Shimosato | |

FOREIGN PATENT DOCUMENTS

| | | | |
|---|---|---|---|
| EP | 1302323 | A3 | 4/2003 |
| JP | 1983051159 | A | 3/1983 |
| JP | 1984225959 | A | 12/1984 |
| JP | 1986169254 | A | 7/1986 |
| JP | 1988231943 | A | 9/1988 |
| JP | 1988252749 | A | 10/1988 |
| JP | 10305587 | A | 11/1998 |

OTHER PUBLICATIONS

European Search Report (EP Appl'n No. 06252590.2—counterpart of above-captioned U.S. Patent application) dated Aug. 22, 2006.

* cited by examiner

*Primary Examiner*—Lam Son Nguyen
(74) *Attorney, Agent, or Firm*—Baker Botts L.L.P.

(57) ABSTRACT

Negative pressure applying means for generating a meniscus in a nozzle hole through a balance with a negative pressure applied to an ink chamber via a restrictor part; pressurizing means for supplying pressurized ink to the ink chamber; withdrawal controlling means for drive-controlling an actuator for changing the volume in the ink chamber to withdraw the meniscus until the balance with the negative pressure is broken through the change of the volume in the ink chamber in response to the driving of the actuator; and recovery controlling means for, after the negative pressure applying means withdraws the ink in the ink chamber to the restrictor part, controlling the pressurizing means to supply the ink to the ink chamber and again generate the meniscus are provided. The pressurizing means pressurizes the ink under a pressure where the meniscus is not broken, and supplies the ink to the ink chamber.

12 Claims, 9 Drawing Sheets

INK JET RECORDING APPARATUS AND CONTROL METHOD THEREOF

CROSS-REFERENCE TO RELATED APPLICATIONS

This Nonprovisional application claims priority under 35 U.S.C. §119(a) on Patent Application No. 2005-156042 filed in Japan on May 27, 2005, the entire contents of which are hereby incorporated by reference.

BACKGROUND

The present invention relates to an ink jet recording apparatus that drives an actuator and discharges ink in an ink chamber from a nozzle, and a control method of the inkjet recording apparatus.

Conventionally, as a recording apparatus that is relatively simple in configuration and easy in high speed recording and high quality recording, an ink jet recording apparatus is known. The ink jet recording apparatus supplies ink to an ink chamber of a recording head, drives a piezoelectric element and the like in accordance with an image data, and discharges the ink in the ink chamber as an ink drop from a nozzle to a recording medium such as a paper and the like, and then records a pattern of an ink dot. However, there is a case where a micro air bubble dissolved in the ink is grown in the ink chamber and the like, and the air bubble is generated in the ink chamber, and a discharging defect is consequently induced.

So, a purging operation and a flushing operation are carried out to try the removal of the air bubble. For example, as described in Japanese Patent Application Laid Open No. 10-305587 (1998), in situation where a cap is in contact with a nozzle surface of a recording head, a suction pump linked to the cap is used to suck the ink inside a nozzle chamber together with the air bubble and exhaust to outside. Or, the ink is pressurized, and the ink inside the nozzle chamber together with the air bubble is discharged to the cap and exhausted to the outside.

SUMMARY

The conventional technique has a problem that although the air bubble can be exhausted, the air bubble together with the ink is exhausted, and the ink is uselessly discarded.

It is therefore an object to provide the ink jet recording apparatus that can surely exhaust the air bubble without uselessly discarding the ink.

In order to attain the object, the following means is employed to solve the problems. That is, this is an ink jet recording apparatus, comprising: a recording head including a nozzle hole that discharges ink, an ink chamber that is linked to the nozzle hole, an actuator for changing the volume in the ink chamber, a manifold for supplying ink to the ink chamber, and a restrictor part provided between the ink chamber and the manifold; a negative pressure applying unit for generating a meniscus in said nozzle hole through a balance with a negative pressure applied to said ink chamber via said restrictor part; a pressurizing unit for pressurizing and supplying ink to said ink chamber; and a controller capable of: drive-controlling said actuator to withdraw said meniscus until the balance with said negative pressure is broken through the change of the volume in the ink chamber in response to the driving of said actuator; and after said negative pressure applying unit withdraws said ink in said ink chamber to said restrictor part, controlling said pressurizing unit to supply said ink to said ink chamber and again generate said meniscus, wherein said actuator is driven to discharge said ink in said ink chamber from said nozzle hole.

The ink jet recording apparatus withdraws the meniscus to the restrictor part through the change of the volume in the ink chamber in response to the driving of said actuator one time and introduces the air into the ink chamber and then supplies the ink to the ink chamber and again generates the meniscus. Thus, the apparatus provides the effect that enables the air bubble to be surely exhausted without uselessly discarding the ink.

The above and further objects and features will more fully be apparent from the following detailed description with accompanying drawings.

DETAILED DESCRIPTION OF THE EXEMPLARY EMBODIMENTS

The best mode of carrying out this embodiment will be described below in detail with reference to the drawings.

Figure 1:
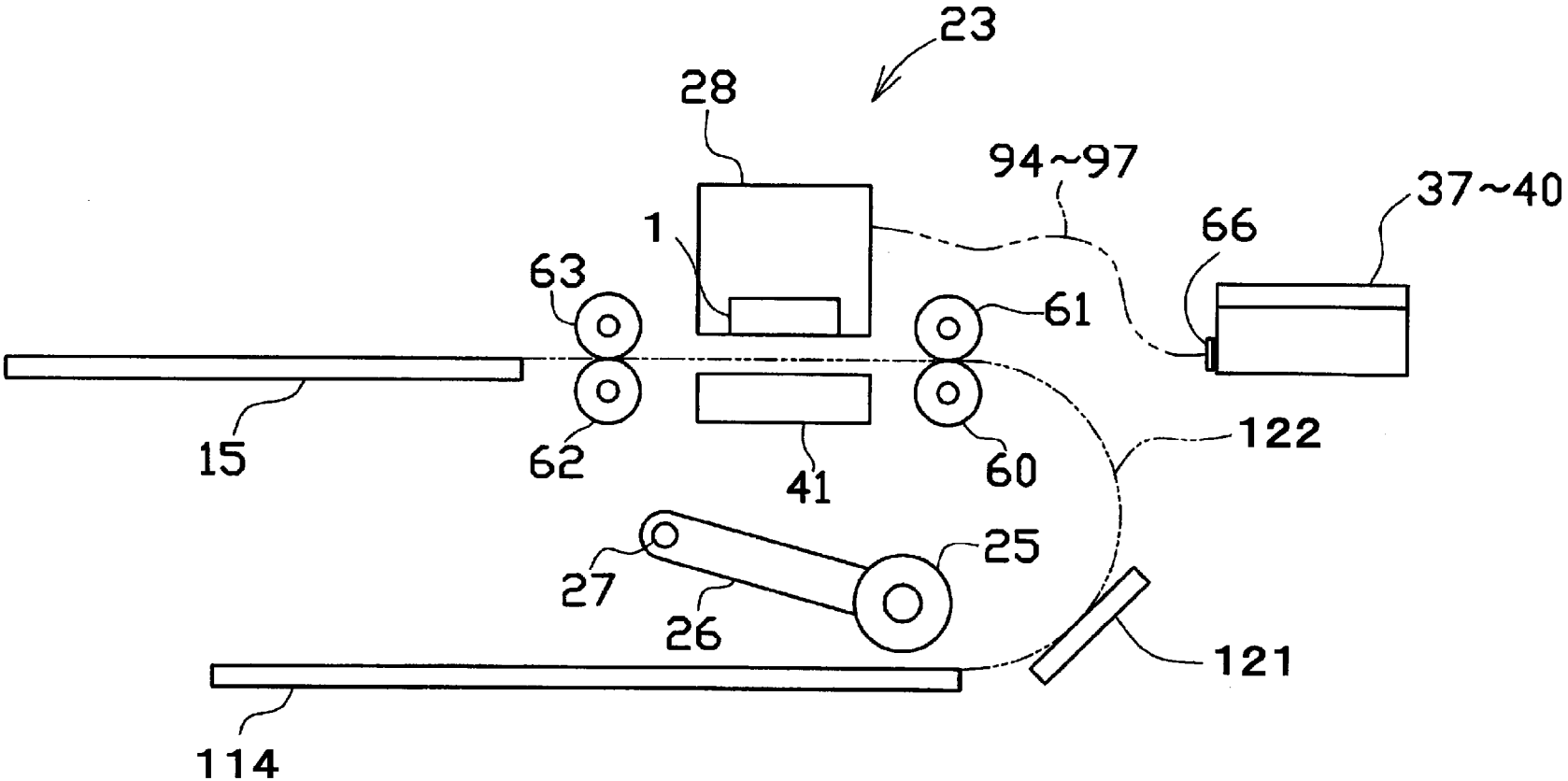
FIG. 1 is a schematic view showing the structure of an ink jet recording apparatus as an embodiment.

FIG. 1 is a schematic view showing the structure of an ink jet recording apparatus as an embodiment. In FIG. 1, a direction perpendicular to the plane of the paper is the width direction of the ink jet recording apparatus and is also a later-described main scanning direction of a recording head 1.

A paper feed tray 114 is provided at the bottom of the ink jet recording apparatus. Disposed on the back side (right side in FIG. 1) of the paper feed tray 114 is a separation tilt plate 121 for separating a piece of recording paper stacked on the paper feed tray 114 and guiding it upward. A transport path 122 is formed to run upward from the separation tilt plate 121. The transport path 122 extends upward and is then curved to the left, so that it extends from the back side to the front side of the ink jet recording apparatus (from the right side to the left side in FIG. 1). Further, the transport path 122 passes through an image recording section 23 and reaches the paper discharge tray 15. Hence, the recording paper stored in the paper feed tray 114 is guided from the lower side to the upper side as if it makes a U turn along the transport path 122, and reaches the image recording section 23. After the image recording section 23 records an image on the recording paper, the recording paper is discharged onto the paper discharge tray 15. The direction along the transport path 122 is the transport direction of the recording paper. The transport direction and the above-mentioned main scanning direction cross each other at a right angle.

A paper feed roller 25 is provided above the paper feed tray 114. The paper feed roller 25 separates recording paper one sheet at a time from the recording paper stacked on the paper feed tray 114 and supplies it to the transport path 122. The paper feed roller 25 has a known structure, and, for example, is supported with a shaft located on an end of a paper feed arm 26 that moves up and down to make contact with or separate from the paper feed tray 114. The paper feed roller 25 is connected to a motor through a drive transmission mechanism. The drive transmission mechanism may be constructed by engaging a plurality of gears with each other. When the motor is activated, a drive force thereof is transmitted to the paper feed roller 25, and the paper feed roller 25 rotates.

The paper feed arm 26 is arranged rotatably around a base end shaft 27. Thus, the paper feed arm 26 can swing in the upward and downward directions about the base end shaft 27 as the center of swing. The paper feed arm 26 is lifted up by a paper feed clutch, spring, etc. (not shown) when it is in a standby state, and swings downward when supplying the recording paper. When the paper feed arm 26 swings downward, the paper feed roller 25 supported on the end of the paper feed arm 26 is pressed against the surface of the recording paper on the paper feed tray 114. In this state, the paper feed roller 25 rotates. A frication force produced between the roller surface of the paper feed roller 25 and the recording paper feeds the topmost recording paper to the separation tilt plate 121. The front end of this recording paper comes into contact with the separation tilt plate 121, and the recording paper is guided upward and fed to the transport path 122. When feeding the topmost recording paper by the paper feed roller 25, the recording paper immediately below the topmost recording paper may be fed together by friction, an electrostatic function, etc. However, this recording paper is stopped by coming into contact with the separation tilt plate 121.

Figure 2:
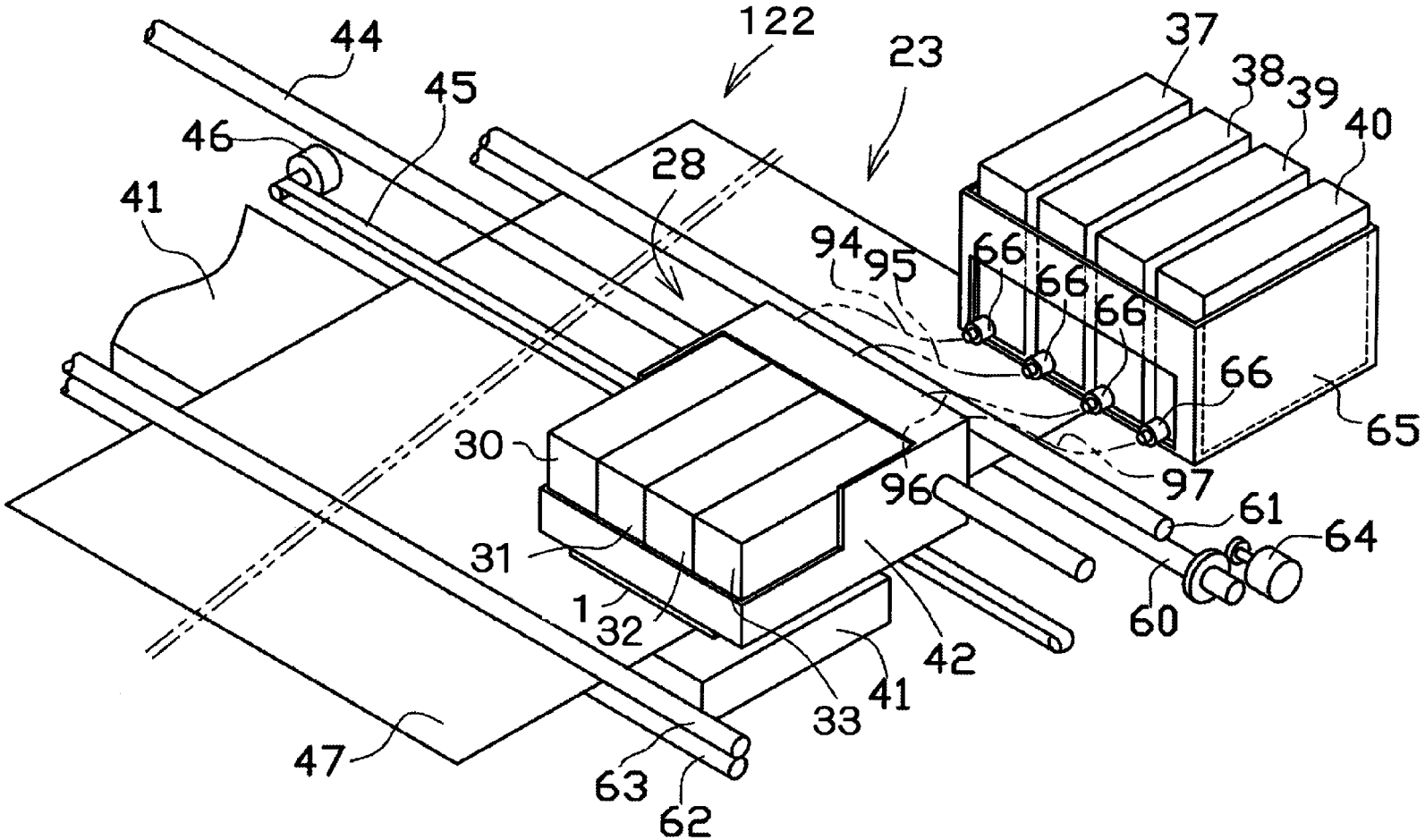
FIG. 2 is a perspective view schematically showing the structure of an image recording section of the ink jet recording apparatus as an embodiment.

As described above, the image recording section 23 is located on the downstream side after the transport path 122 makes a U turn from the lower side to the upward side. FIG. 2 is a perspective view schematically showing the structure of the image recording section 23.

As shown in FIGS. 1 and 2, a drive roller 60 and a press roller 61 are provided on the upstream side of the image recording section 23. The drove roller 60 and press roller 61 sandwich recording paper 47 transported along the transport path 122, and send it onto the platen 41. On the other hand, a paper discharge roller 62 and a press roller 63 are provided on the downstream side of the image recording section 23. The paper discharge roller 62 and press roller 63 sandwich and transport the recorded recording paper 47. The drive roller 60 is driven to rotate by a motor 64, and the paper discharge roller 62 is driven to rotate by a similar motor. Thus, the recording paper 47 is fed intermittently by a predetermined line feed width.

As shown in FIGS. 1 and 2, the image recording section 23 comprises a head section 28, a platen 41 placed to face the head section 28, cartridge-type ink tanks 37 to 40 in which inks are stored in advance, and a pump (not shown) for supplying the inks to the head section 28 from the respective ink tanks 37 to 40.

The ink tanks 37 to 40 are not necessarily be of cartridge type if they can store inks. In this embodiment, four ink tanks 37 to 40 are provided and store four color inks (black (Bk), magenta (M), cyan (C), yellow (Y)) in advance. The image recording section 23 is for recording an image on the recording paper 47 transported on the platen 41. Specifically, when the head section 28 slides in the main scanning direction while discharging the respective inks of black (Bk), magenta (M), cyan (C) and yellow (Y) supplied from the ink tanks 37 to 40, the image is recorded on the recording paper 47.

The ink tanks 37 to 40 are connected to connection tubes 94 to 97, respectively, made of flexible tubes. The connection tubes 94 to 97 have flexibility and a sufficient length. Therefore, the connection tubes 94 to 97 can deform to smoothly follow the slide of the head section 28.

As shown in FIG. 2, the head section 28 comprises the recording head 1, scanning carriage 42, and sub-tanks 30 to 33. The respective sub-tanks 30 to 33 are held on the scanning carriage 42. The sub-tanks 30 to 33 are for temporarily storing the inks supplied from the ink tanks 37 to 40. The recording head 1 is also held on the scanning carriage 42. The recording head 1 is arranged to be exposed from the lower surface of the scanning carriage 42. The inks temporarily stored in the sub-tanks 30 to 33 are supplied to the recording head 1, and discharged as ink droplets from the recording head 1. The scanning carriage 42 is supported by a guide shaft 44, and can slide along the guide shaft 44. An endless belt 45 is attached to the scanning carriage 42. A belt drive motor 46 is connected to the endless belt 45 through a pulley, and the head section 28 slides in the main scanning direction when the belt drive motor 46 is activated.

Each of the sub-tanks 30 to 33 (see FIG. 2) corresponding to the respective color inks (Bk, Y, M, C) has a fitting section, not shown. One ends of the above-mentioned connection tubes 94 to 97 are connected to the fitting sections. As shown in FIG. 2, the other ends of the connection tubes 94 to 97 are connected to the ink tanks 37 to 40, respectively. Connection sections 66 to which the other ends of the connection tubes 94 to 97 are connected are provided in the lower part of the respective ink tanks 37 to 40, and the other ends of the connection tubes 94 to 97 are connected to the respective connection sections 66. More specifically, the ink tank 37 and the sub-tank 30 are connected with the connection tube 94, the ink tank 38 and the sub-tank 31 are connected with the connection tube 95, and the ink tank 39 and the sub-tank 32 are connected with the connection tube 96, and the ink tank 40 and the sub-tank 33 are connected with the connection tube 97. The ink tanks 37 to 40 are held by a holder 65. As described above, the ink tanks 37 to 40 store the Bk ink, M ink, C ink, and Y ink, respectively. When the pump is activated, the Y ink is drawn from the ink tank 40 and sent to the sub-tank 33 through the connection tube 97. Similarly, the C ink is supplied from the ink tank 39 to the sub-tank 32, the M ink is supplied from the ink tank 38 to the sub-tank 31, and the Bk ink is supplied from the ink tank 37 to the sub-tank 30.

Figure 3:
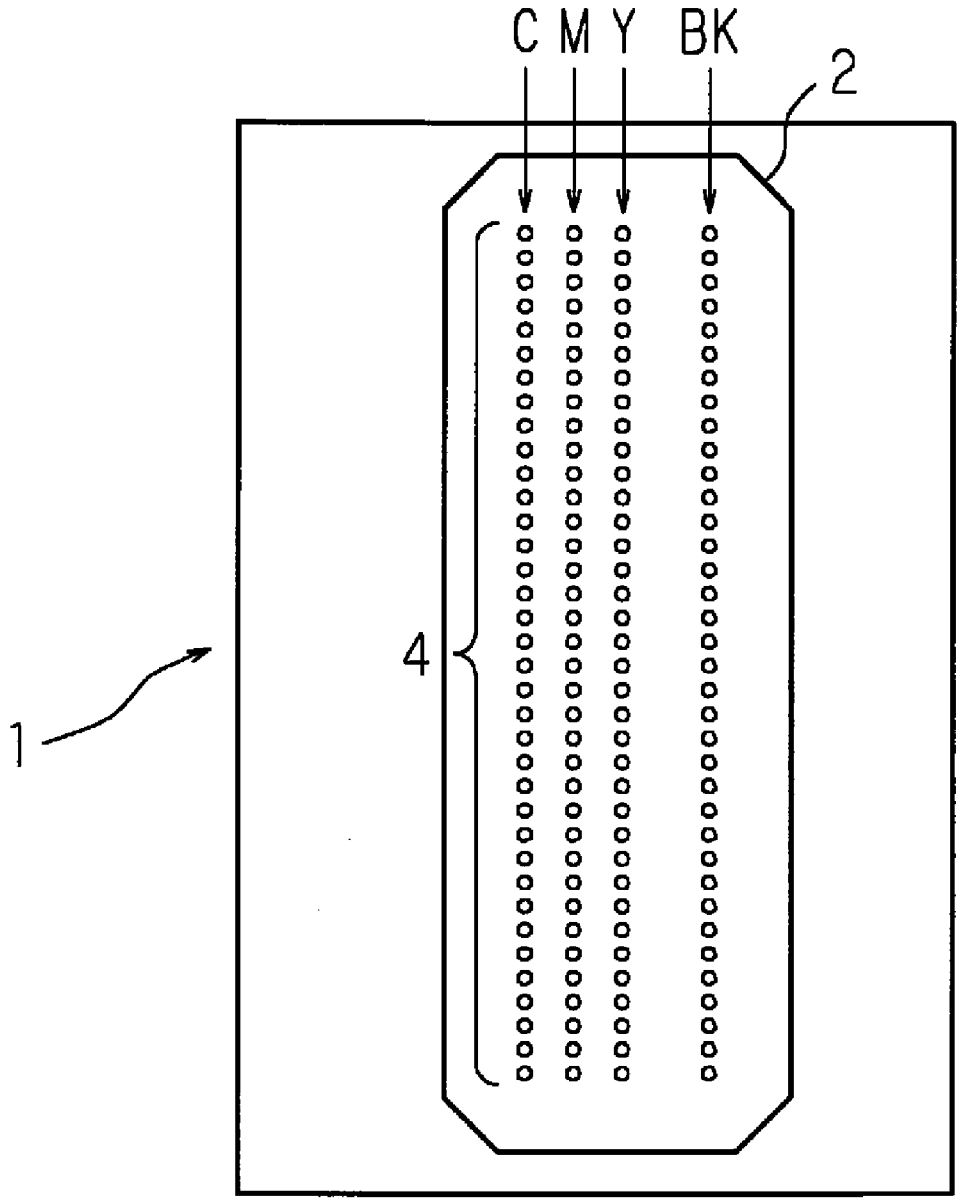
FIG. 3 is a bottom view of a recording head of the ink jet recording apparatus as an embodiment.
Figure 4:
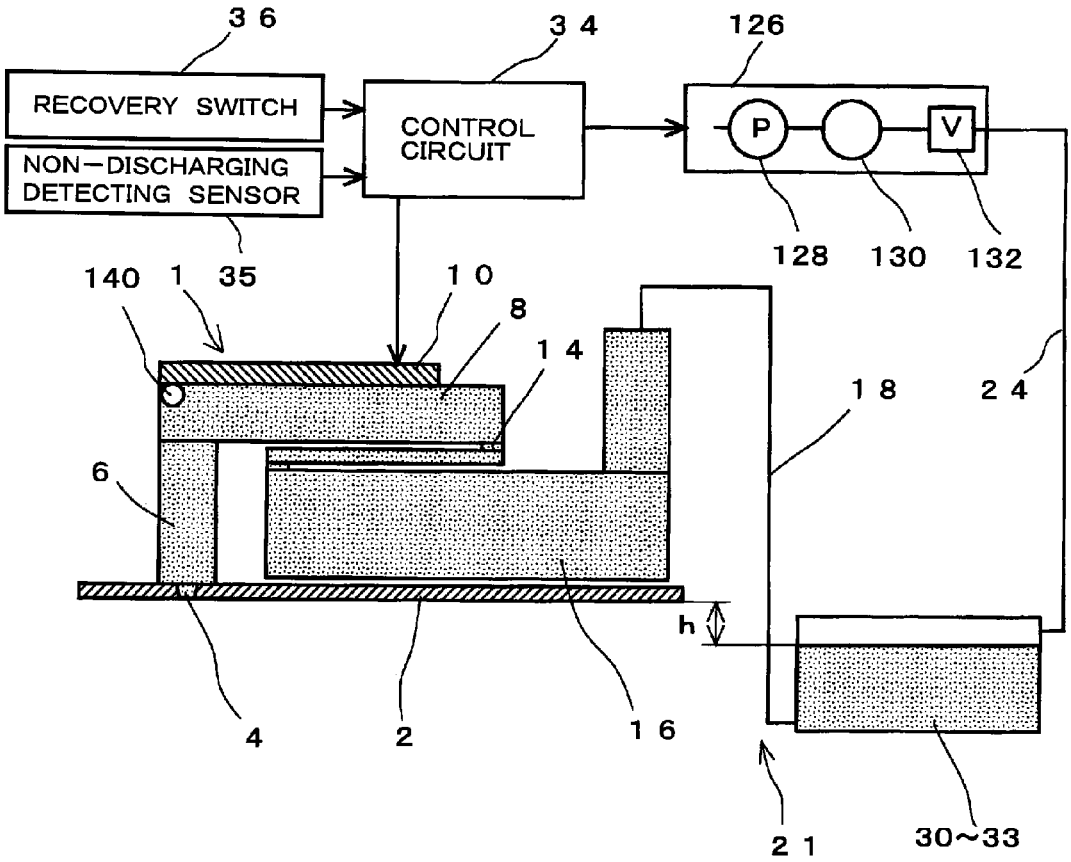
FIG. 4 is a schematic configuration view of the ink jet recording apparatus as an embodiment, including a cross sectional view of the recording head.

FIG. 3 is a bottom view of the recording head 1. FIG. 4 is a schematic configuration view of the ink jet recording apparatus, including a cross sectional view of the recording head 1. FIGS. 3 and 4 schematically show the detailed structure of the recording head 1.

As shown in FIGS. 3 and 4, the recording head 1 comprises a nozzle plate 2, a manifold 16, an ink chamber 8, and a descender 6. The nozzle plate 2 is provided with a plurality of nozzle holes 4. The descender 6 and ink chamber 8 are provided for each nozzle hole 4. The manifold 16 divides the ink guided from the sub-tanks 30 to 33 to the respective nozzle holes 4. The manifold 16 is connected to the sub-tanks 30 to 33 through an ink flow path 18, such as a tube or the like. A plurality of ink chambers 8 corresponding to the respective nozzle holes 4 are provided on the downstream side of the manifold 16. Each ink chamber 8 can easily deform in a resilient manner, and has a piezoelectric element 10 (actuator) on the upper surface thereof. The ink chamber 8 is configured such that its capacity is changed in response to the driving of the piezoelectric element 10, and the ink in the ink chamber 8 is sent toward the descender 6. The descender 6 is attached to the nozzle plate 2. The ink sent from the ink chamber 8 is pushed out through the nozzle hole 4.

As shown in FIG. 3, in this embodiment, a plurality of nozzle holes 4 are arranged. Moreover, the nozzle holes 4 are arranged in four rows in the vertical direction according to the colors of the inks. In FIG. 3, the "vertical direction" is the transport direction of the recording paper 47. The nozzle holes 4 located on the extreme right end in FIG. 3 correspond to the black ink (Bk), and the black ink (Bk ink) is discharged from these nozzle holes 4. Three rows of nozzle holes 4 are provided adjacent to these nozzle holes 4 for the Bk ink. The nozzles holes of these rows correspond to yellow ink (Y ink), magenta ink (M ink), and cyan ink (C ink), respectively, and the Y ink, M ink and C ink are discharged from the respective nozzle holes 4. In short, the recording head 1 can discharge four color inks. Note that, in FIG. 4, although the plurality of nozzle holes 4 arranged in the vertical direction is illustrated only in one row for the purpose of simplifying the explanation, in actual, the plurality of nozzle holes 4 arranged in the vertical direction are arranged in four rows in the left and right directions in FIG. 4.

The ink chamber 8 is linked through a restrictor part 14 to the manifold 16. The restrictor part 14 is formed so as to be opened in the upward and downward directions on the bottom surface of the ink chamber 8, and the manifold 16 is placed on the lower side than the restrictor part 14. The restrictor part 14 is preferred to be formed at the lowest position in the ink chamber 8. Ink is supplied from the ink tanks 37 to 40 to the sub-tanks 30 to 33 such that the level of the upper surface of the ink inside the sub-tanks 30 to 33 is kept substantially constant.

Figure 5A:
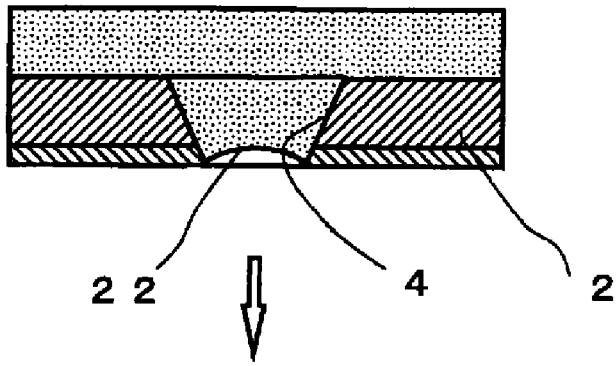
FIGS. 5A to 5C are explanation views of a meniscus generated in a nozzle hole in this embodiment.

In this embodiment, a negative pressure is applied to the ink chamber 8, and as shown in FIG. 5A, the surface tension of a meniscus 22 generated in the nozzle hole 4 and the negative pressure of the ink chamber 8 are balanced and the meniscus 22 is kept.

Figure 5B:
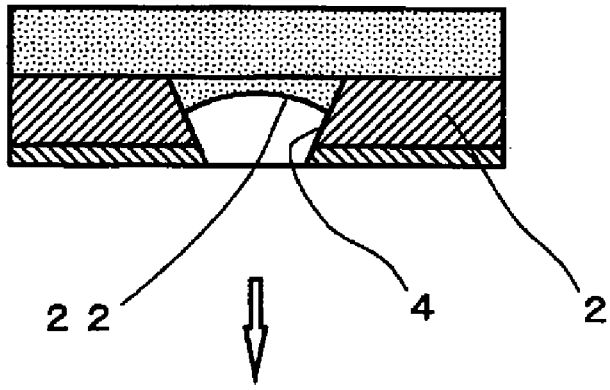
Figure 5C:
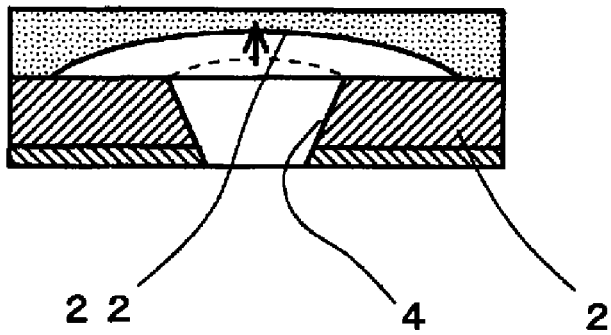

In this embodiment, the negative pressure applied to the ink chamber 8 is configured so as to be applied in accordance with a water head difference h between the upper surface of the ink inside the sub-tanks 30 to 33 and the nozzle hole 4. Negative pressure applying means 21 is constituted by the restrictor part 14, the manifold 16, the ink flow path 18 and the sub-tanks 30 to 33. The negative pressure applied to the ink chamber 8 by the negative pressure applying means 21 is set so as to be balanced with the surface tension of the meniscus 22 generated in the nozzle hole 4 as shown in FIGS. 5A to 5C so that the meniscus 22 is kept. The negative pressure applying means 21 is not limited to the case where the negative pressure is applied in accordance with the water head difference h, and may be configured such that an absorbing material is inserted at a portion on the upstream side in the manifold 16 or the sub-tanks 30 to 33 and then the negative pressure is applied through the absorbing material.

When a voltage is applied to the piezoelectric element 10, the piezoelectric element 10 is driven to increase the capacity of the ink chamber 8, and the ink is sucked through the restrictor part 14 into the ink chamber 8, and the meniscus 22 of the nozzle hole 4 is withdrawn. Then, when the application of the voltage to the piezoelectric element 10 is stopped at a predetermined timing, the ink chamber 8 is returned back to the original capacity, and the meniscus 22 is advanced inside the nozzle hole 4 and discharged as an ink drop from the nozzle hole 4.

When the capacity of the ink chamber 8 is sharply increased, the meniscus 22 is withdrawn inside the nozzle hole 4, and the ink can be sucked through the restrictor part 14 into the ink chamber 8. When the capacity of the ink chamber 8 is sharply returned to the original state, in such a way that the ink drop can be discharged from the nozzle hole 4, the restrictor part 14 is configured to apply a moderate flow path resistance and determined by an experiment and the like. Also, the shape of the restrictor part 14 is formed such that the surface tension of the meniscus generated in the restrictor part 14 and the negative pressure applied by the negative pressure applying means 21 are balanced, in the situation where the nozzle hole 4, descender 6 and ink chamber 8 is filled with the air.

On the other hand, the sub-tanks 30 to 33 are connected through an air flow path 24, such as a tube and the like, to pressurizing means 126. The pressurizing means 126 includes, for example, a tube pump 128, a charging tank 130, a switching valve 132 and the like and can supply compression air through the air flow path 24 to the sub-tanks 30 to 33 and pressurize the ink inside the sub-tanks 30 to 33. The pressure when the pressurizing means 126 pressurizes the ink inside the sub-tanks 30 to 33 is set to a degree that the meniscus 22 generated in the nozzle hole 4 is not broken. For example, it is the pressure of about 4 kPa.

The piezoelectric element 10 and the pressurizing means 126 are connected to a control circuit 34. The control circuit 34 includes a CPU which controls the ink jet recording apparatus in accordance with a control program with regard to the operation content of the ink jet recording apparatus, a ROM, a RAM and the like.

A recovery switch 36 (switch), which is pressed down by the user in the case of the generation of a recording error, such as a light-brush stroke or the like, when a test pattern or the like is recorded on the recording medium, is connected to the control circuit 34. In a case where a plurality of recording heads 1 corresponding to colors are provided, the recovery switch 36 is provided for each recording head 1.

Also, a non-discharging detecting sensor 35 for detecting whether or not to have been recorded on the recording medium by the ink drop discharged from the nozzle hole 4, is connected to the control circuit 34. The non-discharging detecting sensor 35 detects whether or not to have been recorded due to the discharge of the ink drop by, for example, the reflection of light. If the plurality of nozzle holes 4 are provided, the non-discharging detecting sensor 35 is provided for each nozzle hole 4. Any one of the recovery switch 36 and the non-discharging detecting sensor 35 may be provided and may be provided as necessary.

Figure 6:
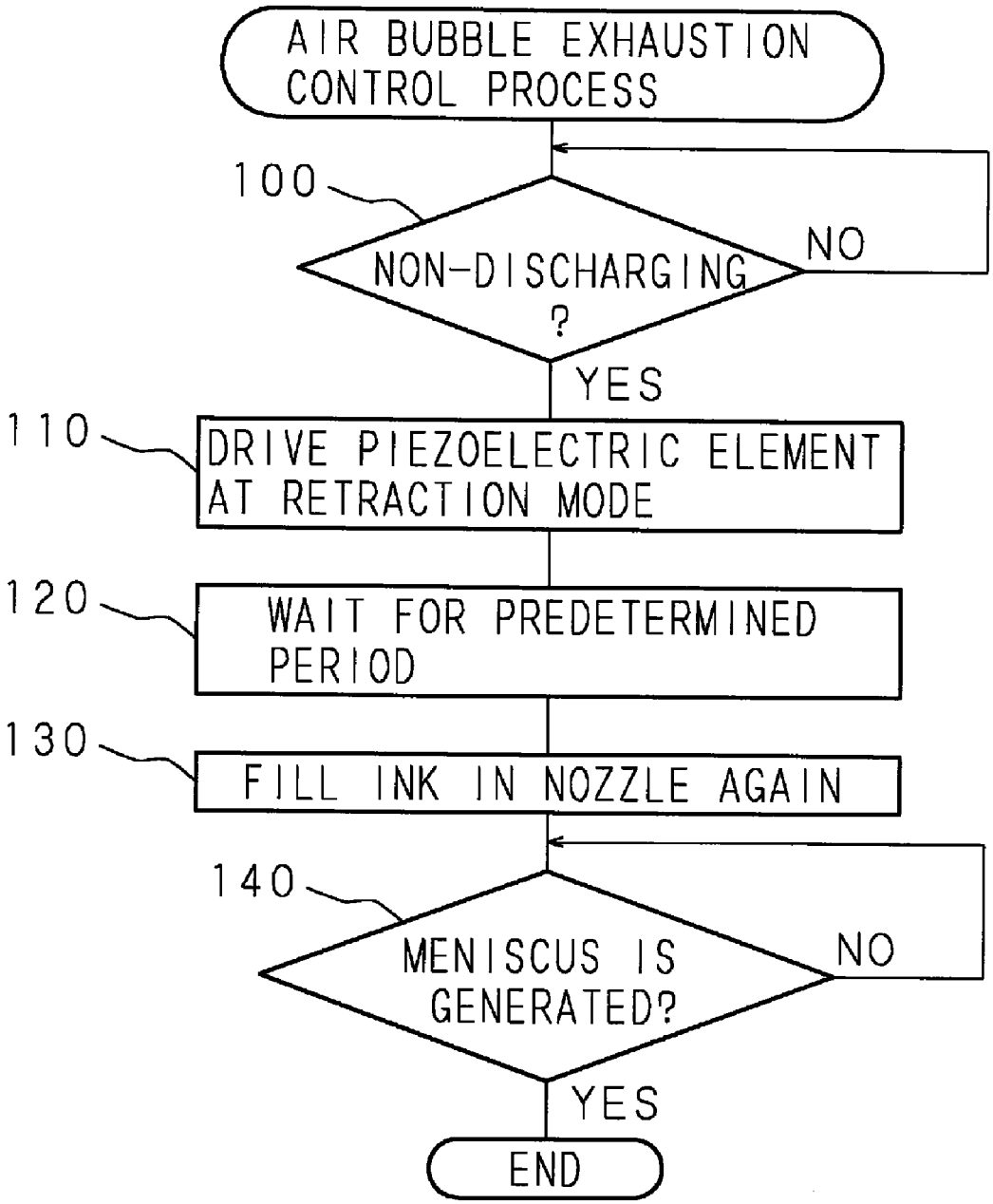
FIG. 6 is a flowchart showing an example of an air bubble exhaustion control process executed in a control circuit in this embodiment.

An air bubble exhaustion control process executed by the control circuit 34 (controller) as mentioned above will be described below together with a flowchart shown in FIG. 6.

Figure 7A:
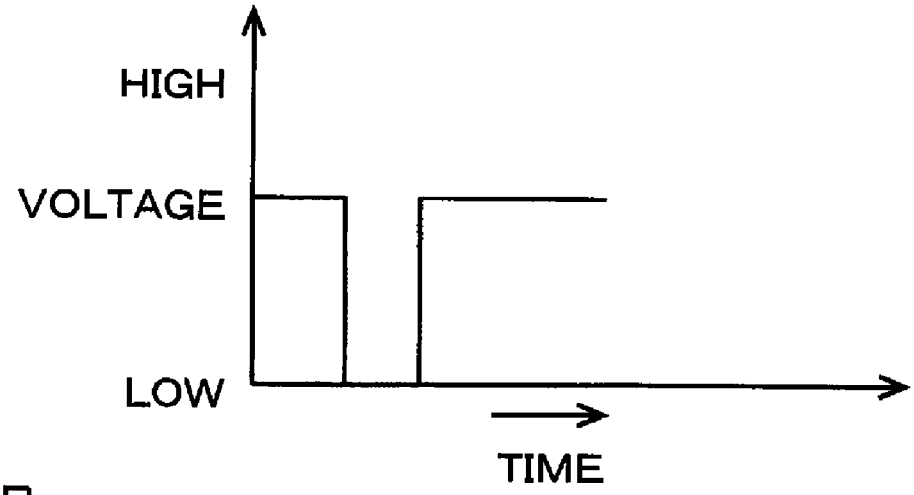
FIGS. 7A and 7B are graphs showing voltage waves to drive a piezoelectric element in this embodiment.

This embodiment uses a negative polarity driving method for withdrawing the meniscus 22 and discharging the ink drop. At a recording mode when recording on the recording medium, as shown in FIG. 7A, the voltage applied to the piezoelectric element 10 is sharply decreased, which sharply deforms the piezoelectric element 10 and sharply increases the capacity of the ink chamber 8 and consequently withdraws the meniscus 22 inside the nozzle hole 4. When it is sharply applied to the piezoelectric element 10 up to a predetermined voltage level at a predetermined timing, the meniscus 22 is advanced inside the nozzle hole 4, and the ink drop is discharged from the nozzle hole 4.

This is repeated, and the piezoelectric element 10 is driven in accordance with the image data. Then, the ink in the ink chamber 8 is discharged as the ink drop from the nozzle hole 4 to the recording medium, and the pattern of an ink dot is recorded. When the ink drop is discharged, the voltage of the piezoelectric element 10 is sharply applied and stopped, and its voltage waveform is rectangular. By the way, as mentioned above, this may be executed in the configuration where by decreasing the voltage applied to the piezoelectric element 10, the capacity of the ink chamber 8 may be increased, or by applying a high voltage to the piezoelectric element 10, the capacity of the ink chamber 8 may be increased.

On the other hand, while the recording is being done, as shown in FIG. 4, when a micro air bubble dissolved in the ink is grown inside the ink chamber 8 and a large air bubble 140 is generated, even if the piezoelectric element 10 is driven, the ink drop is not correctly discharged from the nozzle hole 4, and the discharging defect is induced.

So, the air bubble exhaustion control process is repeatedly executed for each constant period. At first, whether or not there was the non-discharging is judged (Step 100). Whether or not there was the non-discharging is judged in accordance with whether or not there was an input of an instruction signal by the pressing of the recovery switch 36, or whether or not the non-discharging was detected by the non-discharging detecting sensor 35. Also, it is not limited to the recovery switch 36 or the non-discharging detecting sensor 35. The judgment may be done in accordance with the instruction signal from an external apparatus such as a personal computer (not shown) or the like which is connected to the ink jet recording apparatus.

Figure 7B:
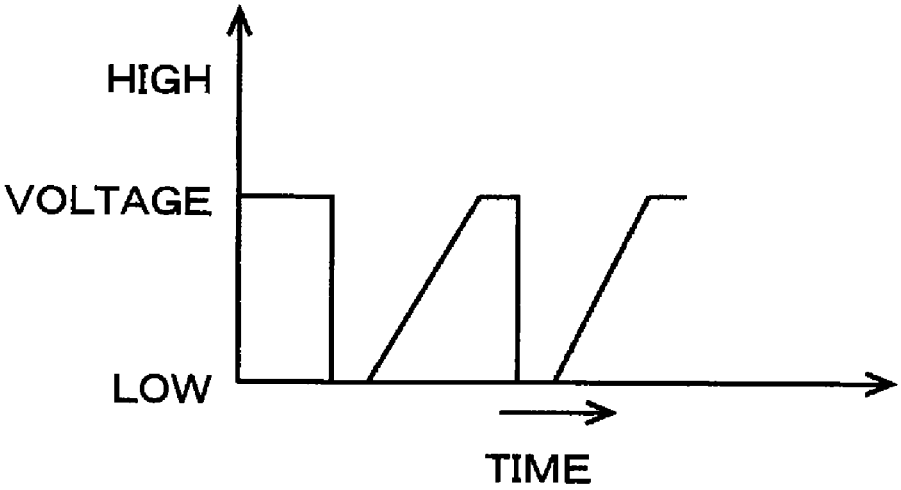

If there was not the non-discharging (Step 100: No), this control process is repeatedly executed, and if the occurrence of the non-discharging is judged (Step 100: Yes), the piezoelectric element 10 is driven at a retraction mode (Step 110). At the retraction mode, as shown in FIG. 7B, the voltage applied to the piezoelectric element 10 is sharply decreased to sharply deform the piezoelectric element 10 and sharply increase the capacity of the ink chamber 8 and consequently withdraw the meniscus 22 inside the nozzle hole 4. After that, the voltage applied to the piezoelectric element 10 is gradually increased to return the deformation of the piezoelectric element 10 back to the original state and gradually return the ink chamber 8 back to the original capacity.

The method in which the application of the negative pressure applied by the negative pressure applying means 21, the shape of the restrictor part 14 or the like causes the ink in the ink chamber 8 to flow out through the restrictor part 14 into the manifold 16 is smaller in flow path resistance than the method which advances the meniscus 22 inside the nozzle hole 4. Thus, by gradually returning the increased capacity of the ink chamber 8, the ink in the ink chamber 8 flows out through the restrictor part 14 into the manifold 16. The meniscus 22 keeps the withdrawn state, as shown in FIG. 5B.

At that time, the air bubble 140 is generated in the ink chamber 8. Thus, when the capacity of the ink chamber 8 is sharply increased, for example, the air pressure inside the air bubble 140 is decreased, thereby expanding the air bubble 140. However, after that, the air bubble 140 is contracted such that the air pressure of the air bubble 140 and the ink pressure are made equal, and the meniscus 22 is withdrawn at the withdrawal speed of the meniscus 22 which is slower than the speed when there is not the air bubble 140. Then, since the capacity of the ink chamber 8 is gradually returned, the air pressure of the air bubble 140 and the ink pressure are kept in the same state, and the ink in the ink chamber 8 flows out through the restrictor part 14 into the manifold 16, and the meniscus 22 is kept in the withdrawn state.

As mentioned above, repeating the driving of the piezoelectric element 10 sharply increases the capacity of the ink chamber 8 and gradually returns to the original capacity and continuously withdraws the meniscus 22. As shown in FIG. 5C, when the meniscus 22 retracts from the nozzle hole 4 and arrives at the inside of the descender 6, the negative pressure applied by the negative pressure applying means 21 and the surface tension of the meniscus 22 are unbalanced, and by the negative pressure applying means 21, the ink inside the ink chamber 8 is sucked through the restrictor part 14 into the manifold 16, the ink flow path 18 and the sub-tanks 30 to 33. When the driving of the piezoelectric element 10 is executed a preset number of times (for example, 50 to 100 times), the meniscus 22 may retract from the nozzle hole 4. Or, when it is driven for a predetermined period (for example, 5 to 10 msec), the meniscus 22 may retract from the nozzle hole 4.

Figure 8:
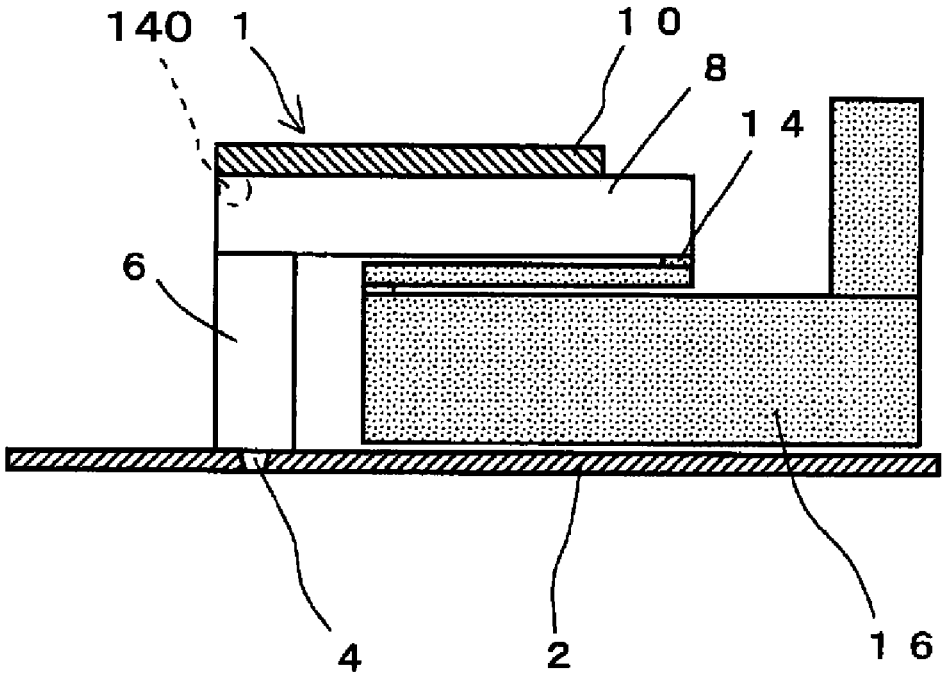
FIG. 8 is a configuration view showing a situation where ink is withdrawn to a restrictor part in this embodiment.

After the piezoelectric element 10 is driven at the retraction mode, it waits for a predetermined period (for example, 3 to 10 seconds) (Step 120). Until the elapse of this predetermined period, as shown in FIG. 8, the meniscus 22 is withdrawn, and the air is sucked from the nozzle hole 4, and together with the withdrawal of the ink inside the ink chamber 8, the air is advanced into the ink chamber 8. Then, the air bubble 140 inside the ink chamber 8 and the advanced air are integrated, and the air bubble 140 is removed.

When the ink withdrawn through the ink chamber 8 arrives at the restrictor part 14, the meniscus is generated on the restrictor part 14. Then, the surface tension of the meniscus on this restrictor part 14 and the negative pressure applied by the negative pressure applying means 21 are balanced, and as shown in FIG. 8, the withdrawal of the ink is stopped on the restrictor part 14.

Figure 9:
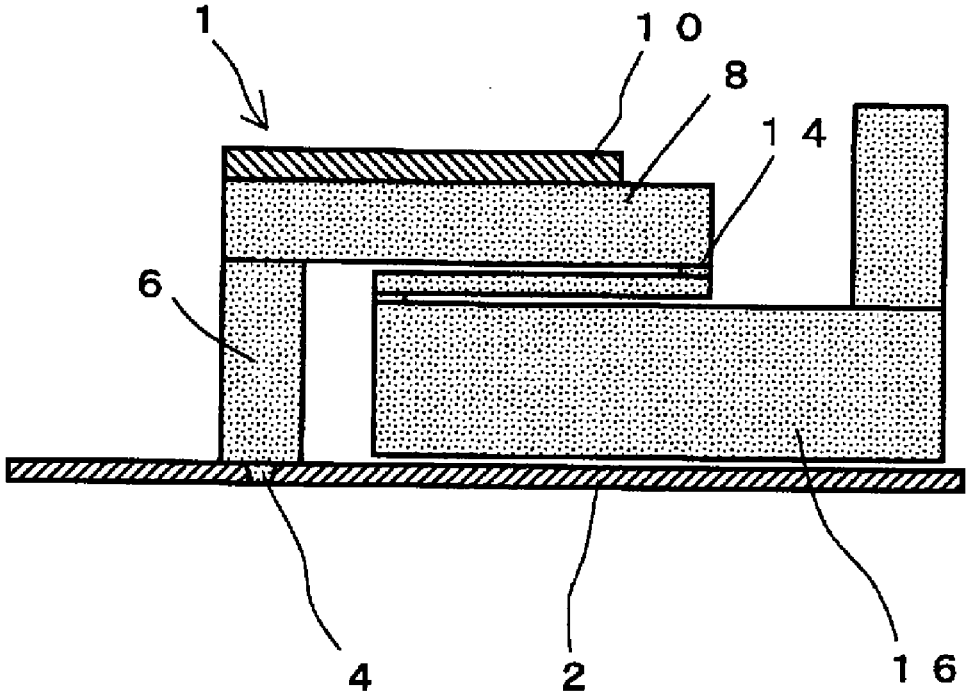
FIG. 9 is a configuration view showing a situation where the ink is supplied to an ink chamber and then the meniscus is re-generated in this embodiment.

After the waiting for the predetermined period is ended, the driving of the pressurizing means 126 is controlled. Then, the compressed air is supplied to the sub-tanks 30 to 33, and the ink is pressurized (Step 130). Thus, as shown in FIG. 9, the ink is supplied from the sub-tanks 30 to 33 through the ink flow path 18, the manifold 16 and the restrictor part 14 to the ink chamber 8. The supplied ink is again filled in the ink chamber 8 and the descender 6. Also, inside the nozzle hole 4, the meniscus 22 is again generated from the supplied ink.

The pressurizing means 126 pressurizes the ink to a degree that the meniscus 22 generated in the nozzle hole 4 is not broken. Thus, when the meniscus 22 is generated in the nozzle hole 4, the surface tension of the meniscus 22 and the pressure force applied by the pressurizing means 126 are balanced, and the ink is not discharged from the nozzle hole 4. Hence, the flow of the ink is stopped to keep the state where the meniscus 22 is generated in the nozzle hole 4.

After the pressurizing means 126 is driven for the predetermined period, the meniscus 22 is judged to be generated (Step 140: Yes), and this control process is ended one time. It is kept in the state where the surface tension of the meniscus 22 and the pressure force applied by the pressurizing means 126 are balanced and the meniscus 22 is generated. Thus, if the pressurizing means 126 is driven for the sufficient period until the generation of the meniscus 22, the meniscus 22 is generated. In this way, even if the air bubble 140 is generated, the air bubble 140 can be removed without uselessly discarding the ink inside the ink chamber 8.

Moreover, for the pressurizing means 126, the device that can be used for the flushing operation to exhaust the dried ink in the nozzle hole 4 or the like can be used. Also, the piezoelectric element 10 is driven to withdraw the meniscus 22 from the nozzle hole 4, and the negative pressure applying means 21 is used to withdraw the ink to the restrictor part 14. Thus, without any addition of the special configuration, the existing configuration can be used to exhaust the air bubble 140.

When the piezoelectric element 10 is driven in accordance with the instruction signal from the recovery switch 36, all of the piezoelectric elements 10 in the recording heads 1 of the colors corresponding to the recovery switches 36 are similarly driven to withdraw the ink to the restrictor part 14 one time. Then, the ink may be again filled in the ink chamber 8 and the descender 6. Even if the ink in all of the ink chambers 8 is withdrawn, the ink is never uselessly discarded.

Also, the plurality of restrictor parts 14, ink chambers 8, descenders 6 and nozzle holes 4 are provided in one manifold 16, and the non-discharging detecting sensor 35 is provided for each nozzle hole 4. When the non-discharging detecting sensor 35 detects the non-discharging, among the plurality of nozzle holes 4 provided on the recording head 1, only the piezoelectric element 10 of the ink chamber 8 corresponding to the nozzle hole 4 where the non-discharging is detected may be driven to remove the air bubble 140. Thus, the piezoelectric element 10 is never uselessly driven, which leads to the energy saving. Also, an additional device for maintenance is not required.

By the way, in this embodiment, the execution of the process at the step 110 serves as the withdrawal controlling means, and the execution of the processes at the steps 120, 130 and 140 serves as the recovery controlling means.

By the way, in this embodiment, when a voltage is applied to the piezoelectric element, the piezoelectric element is driven to change the volume of the ink chamber. However, for example, this embodiment is applicable to a recording head that changes the volume in the ink chamber using electrostatic force.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

The invention claimed is:

1. An ink jet recording apparatus, comprising:

a recording head including a nozzle hole that discharges ink, an ink chamber that is linked to the nozzle hole, an actuator for changing the volume in the ink chamber, a manifold for supplying ink to the ink chamber, and a restrictor part provided between the ink chamber and the manifold;

a negative pressure applying unit for generating a meniscus in said nozzle hole through a balance with a negative pressure applied to said ink chamber via said restrictor part;

a pressurizing unit for pressurizing and supplying ink to said ink chamber; and a controller capable of: drive-controlling said actuator to withdraw said meniscus until the balance with said negative pressure is broken through the change of the volume in the ink chamber in response to the driving of said actuator; and after said negative pressure applying unit withdraws said ink in said ink chamber to said restrictor part, controlling said pressurizing unit to supply said ink to said ink chamber and again generate said meniscus, wherein said actuator is driven to discharge said ink in said ink chamber from said nozzle hole.

2. The ink jet recording apparatus according to claim 1, wherein said pressurizing unit pressurizes said ink under a pressure where said meniscus is not broken and supplies said ink to said ink chamber.

3. The ink jet recording apparatus according to claim 1, further comprising a switch, wherein in accordance with an instruction signal from the switch, said meniscus is again generated.

4. The ink jet recording apparatus according to claim 1, further comprising a non-discharging detecting sensor for detecting the non-discharging of the ink from said nozzle hole, wherein when the non-discharging detecting sensor detects the non-discharging of the ink, said meniscus is again generated.

5. The ink jet recording apparatus according to claim 1, wherein said controller is further capable of driving said actuator such that the capacity of the ink chamber is sharply increased and the increased capacity of the ink chamber is gradually returned.

6. An ink jet recording apparatus, comprising:

a recording head including a nozzle hole that discharges ink, an ink chamber that is linked to the nozzle hole, an actuator for changing the volume in the ink chamber, a manifold for supplying ink to the ink chamber, and a restrictor part provided between the ink chamber and the manifold;

negative pressure applying means for generating a meniscus in said nozzle hole through a balance with a negative pressure applied to said ink chamber via said restrictor part;

pressurizing means for pressurizing and supplying ink to said ink chamber;

withdrawal controlling means for drive-controlling said actuator to withdraw said meniscus until the balance with said negative pressure is broken through the change of the volume in the ink chamber in response to the driving of said actuator; and recovery controlling means for, after said negative pressure applying means withdraws said ink in said ink chamber to said restrictor part, controlling said pressurizing means to supply said ink to said ink chamber and again generate said meniscus, wherein said actuator is driven to discharge said ink in said ink chamber from said nozzle hole.

7. The ink jet recording apparatus according to claim 6, wherein said pressurizing means pressurizes said ink under a pressure where said meniscus is not broken and supplies said ink to said ink chamber.

8. The ink jet recording apparatus according to claim 6, further comprising a switch, wherein in accordance with an instruction signal from the switch, said meniscus is again generated.

9. The ink jet recording apparatus according to claim 6, further comprising a non-discharging detecting sensor for detecting the non-discharging of the ink from said nozzle hole, wherein when the non-discharging detecting sensor detects the non-discharging of the ink, said meniscus is again generated.

10. The ink jet recording apparatus according to claim 6, wherein said withdrawal controlling means drives said actuator such that the capacity of the ink chamber is sharply increased and the increased capacity of the ink chamber is gradually returned.

11. A control method of an inkjet recording apparatus that comprises: a recording head including a nozzle hole that discharges ink, an ink chamber that is linked to the nozzle hole, an actuator for changing the volume in the ink chamber, a manifold for supplying ink to the ink chamber, and a restrictor part provided between the ink chamber and the manifold; a negative pressure applying unit for generating a meniscus in said nozzle hole through a balance with a negative pressure applied to said ink chamber via said restrictor part; and a pressurizing unit for pressurizing and supplying ink to said ink chamber, and that drives said actuator to discharge said ink in said ink chamber from said nozzle hole, comprising the steps of:

drive-controlling said actuator to withdraw said meniscus until the balance with said negative pressure is broken through the change of the volume in the ink chamber in response to the driving of said actuator; and after said negative pressure applying unit withdraws said ink in said ink chamber to said restrictor part, controlling said pressurizing unit to supply said ink to said ink chamber and again generate said meniscus.

12. The control method of an inkjet recording apparatus according to claim 11, wherein said actuator is driven such that the capacity of the ink chamber is sharply increased and the increased capacity of the ink chamber is gradually returned.

* * * * *